US006796376B2

(12) United States Patent
Frazier

(10) Patent No.: US 6,796,376 B2
(45) Date of Patent: Sep. 28, 2004

(54) COMPOSITE BRIDGE PLUG SYSTEM

(76) Inventor: Warren L. Frazier, 5353 CR 73, Robstown, TX (US) 78380

( * ) Notice: Subject to any disclaimer, the term of this patent is extended or adjusted under 35 U.S.C. 154(b) by 32 days.

(21) Appl. No.: 10/189,887

(22) Filed: Jul. 2, 2002

(65) Prior Publication Data

US 2004/0003928 A1 Jan. 8, 2004

(51) Int. Cl.[7] ..... E21B 23/00; E21B 33/12

(52) U.S. Cl. ..... 166/134; 166/118; 166/123; 166/138; 166/387

(58) Field of Search ..... 166/387, 376, 166/118, 184, 217, 138, 140, 123, 127

(56) References Cited

U.S. PATENT DOCUMENTS 3,298,437 A * 1/1967 Conrad ..... 166/63
3,306,362 A * 2/1967 Urbanosky ..... 277/339
4,151,875 A * 5/1979 Sullaway ..... 166/126
4,708,202 A * 11/1987 Sukup et al. ..... 166/123
4,784,226 A * 11/1988 Wyatt ..... 166/376
5,318,131 A * 6/1994 Baker ..... 166/382
5,390,737 A * 2/1995 Jacobi et al. ..... 166/184
5,540,279 A * 7/1996 Branch et al. ..... 166/118
5,701,959 A * 12/1997 Hushbeck et al. ..... 166/387
5,819,846 A * 10/1998 Bolt, Jr. ..... 166/123
6,167,963 B1 * 1/2001 McMahan et al. ..... 166/179
6,220,349 B1 * 4/2001 Vargus et al. ..... 166/138
6,491,108 B1 * 12/2002 Slup et al. ..... 166/387
6,581,681 B1 * 6/2003 Zimmerman et al. ..... 166/135

* cited by examiner

*Primary Examiner*—David Bagnell
*Assistant Examiner*—Shane Bomar
(74) *Attorney, Agent, or Firm*—G. Turner Moller

(57) ABSTRACT

A composite bridge plug system for containing a well bore with reduced drill up time. The composite bridge plug system includes an elongate mandrel, a head member attached to a lower portion of the mandrel, an upper collar positioned about an upper portion of the mandrel, and a plurality of gripping members positioned about the mandrel. The gripping members are expandable outwardly when the mandrel is pulled upwardly with an engaging tube preventing the upward movement of the upper collar thereby compressing the gripping members. The upper portion of the mandrel includes a shear portion that is breakable by pulling upwardly upon the mandrel. An engaging portion surrounds the shear portion adjacent to the upper collar that is engageable with a lower slot within a head member of a higher bridge plug thereby preventing rotation of the higher bridge plug during drilling thereof.

4 Claims, 9 Drawing Sheets

COMPOSITE BRIDGE PLUG SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to bridge plugs and more specifically it relates to a composite bridge plug system for containing a well bore with reduced drill up time.

2. Description of the Related Art

Bridge plugs have been in use for years. Conventional bridge plugs are comprised of a metallic material which is lowered into a well bore via a wire line or steel tube. To set the conventional bridge plugs within the well bore, the user caused slips within the bridge plug to extend outwardly thereby contacting the well bore walls and an elastomeric packing element to seal to the well bore by using an electronic means or pump force.

While these devices may be suitable for the particular purpose to which they address, they are not as suitable for containing a well bore with reduced drill up time. Conventional bridge plugs are difficult to remove from a well bore by conventional drilling because they are rotated within the well bore.

In these respects, the composite bridge plug system according to the present invention substantially departs from the conventional concepts and designs of the prior art, and in so doing provides an apparatus primarily developed for the purpose of containing a well bore with reduced drill up time.

BRIEF SUMMARY OF THE INVENTION

In view of the foregoing disadvantages inherent in the known types of bridge plugs now present in the prior art, the present invention provides a new composite bridge plug system construction wherein the same can be utilized for containing a well bore with reduced drill up time.

The general purpose of the present invention, which will be described subsequently in greater detail, is to provide a new composite bridge plug system that has many of the advantages of the bridge plugs mentioned heretofore and many novel features that result in a new composite bridge plug system which is not anticipated, rendered obvious, suggested, or even implied by any of the prior art bridge plugs, either alone or in any combination thereof.

To attain this, the present invention generally comprises an elongate mandrel, a head member attached to a lower portion of the mandrel, an upper collar positioned about an upper portion of the mandrel, and a plurality of gripping members positioned about the mandrel. The gripping members are expandable outwardly when the mandrel is pulled upwardly with an engaging tube preventing the upward movement of the upper collar thereby compressing the gripping members. The upper portion of the mandrel includes a shear portion that is breakable by pulling upwardly upon the mandrel. An engaging portion surrounds the shear portion adjacent to the upper collar that is engageable with a lower slot within a head member of a higher bridge plug thereby preventing rotation of the higher bridge plug during drilling thereof.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a composite bridge plug system that will overcome the shortcomings of the prior art devices.

A second object is to provide a composite bridge plug system for containing a well bore with reduced drill up time.

Another object is to provide a composite bridge plug system that utilizes a combination of metal and non-metal components for containing a conduit.

An additional object is to provide a composite bridge plug system that may be utilized within oil or gas well bores.

A further object is to provide a composite bridge plug system that reduces milling or drill out operations of the bridge plug.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
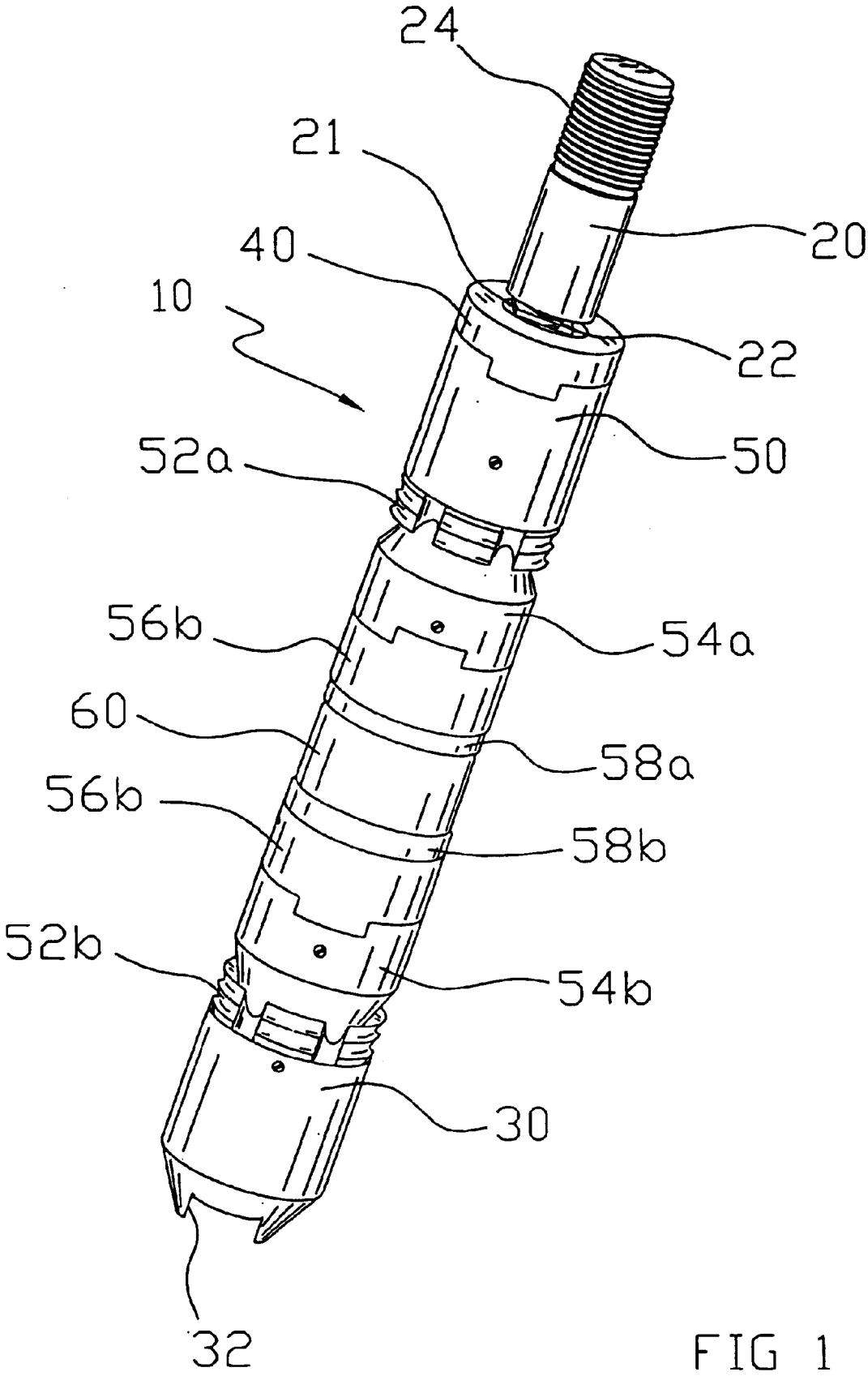
FIG. 1 is an upper perspective view of the present invention.
Figure 2:
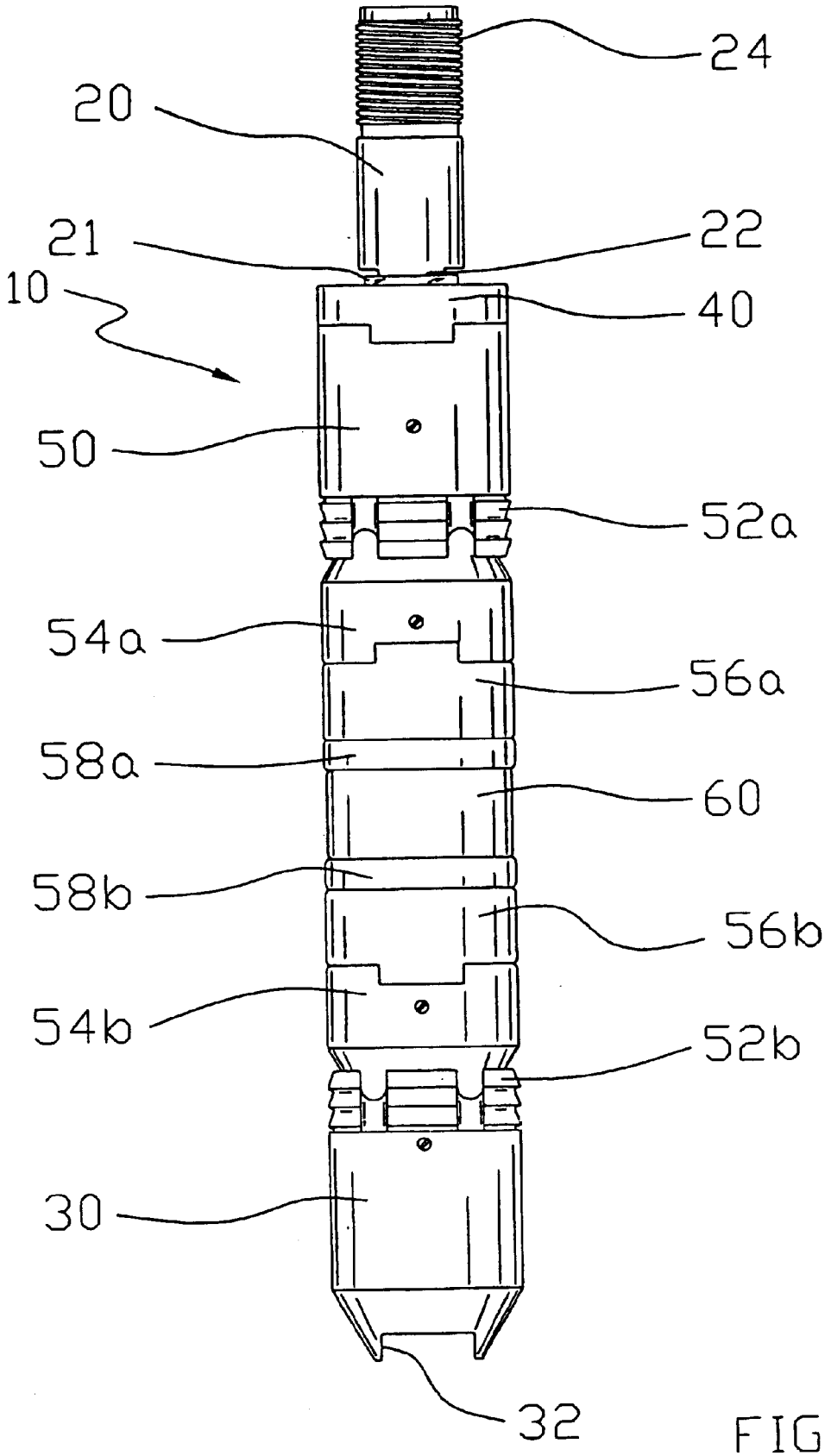
FIG. 2 is a side view of the present invention.

Turning now descriptively to the drawings, in which similar reference characters denote similar elements throughout the several views, FIGS. 1 through 9 illustrate a composite bridge plug system 10, which comprises an elongate mandrel 20, a head member 30 attached to a lower portion 28 of the mandrel 20, an upper collar 40 positioned about an upper portion 24 of the mandrel 20, and a plurality of gripping members 52*a–b* positioned about the mandrel 20. The gripping members 52*a–b* are expandable outwardly when the mandrel 20 is pulled upwardly with an engaging tube 70 preventing the upward movement of the upper collar 40 thereby compressing the gripping members 52*a–b*. The upper portion 24 of the mandrel 20 includes a shear portion 22 that is breakable by pulling upwardly upon the mandrel 20. An engaging portion 21 surrounds the shear portion 22 adjacent to the upper collar 40 that is engageable with a lower slot 32 within a head member 30 of a higher bridge plug thereby preventing rotation of the higher bridge plug during drilling thereof.

Figure 6:
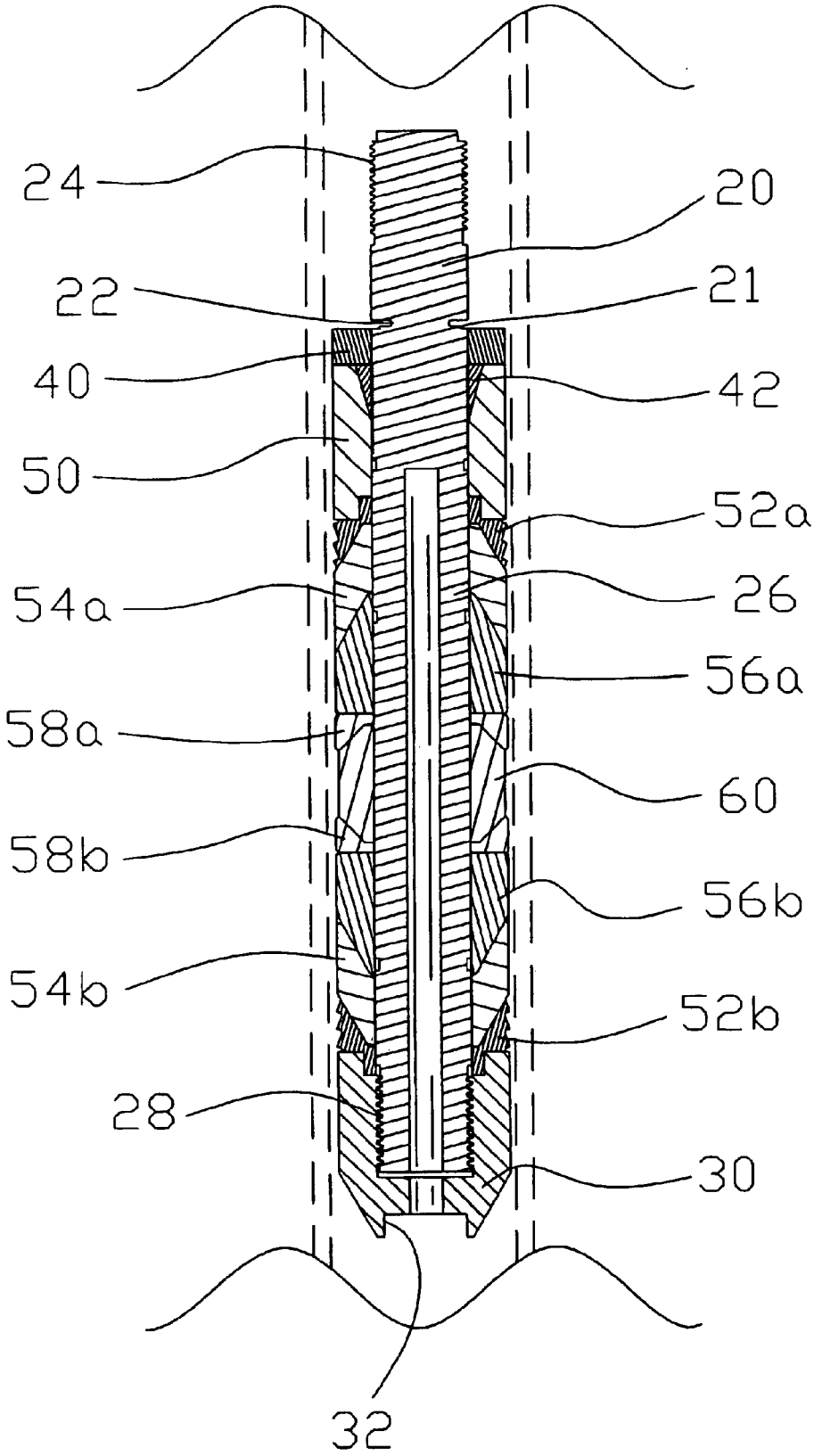
FIG. 6 is a side cutaway view of another embodiment of the present invention movably positioned within the conduit.
Figure 7:
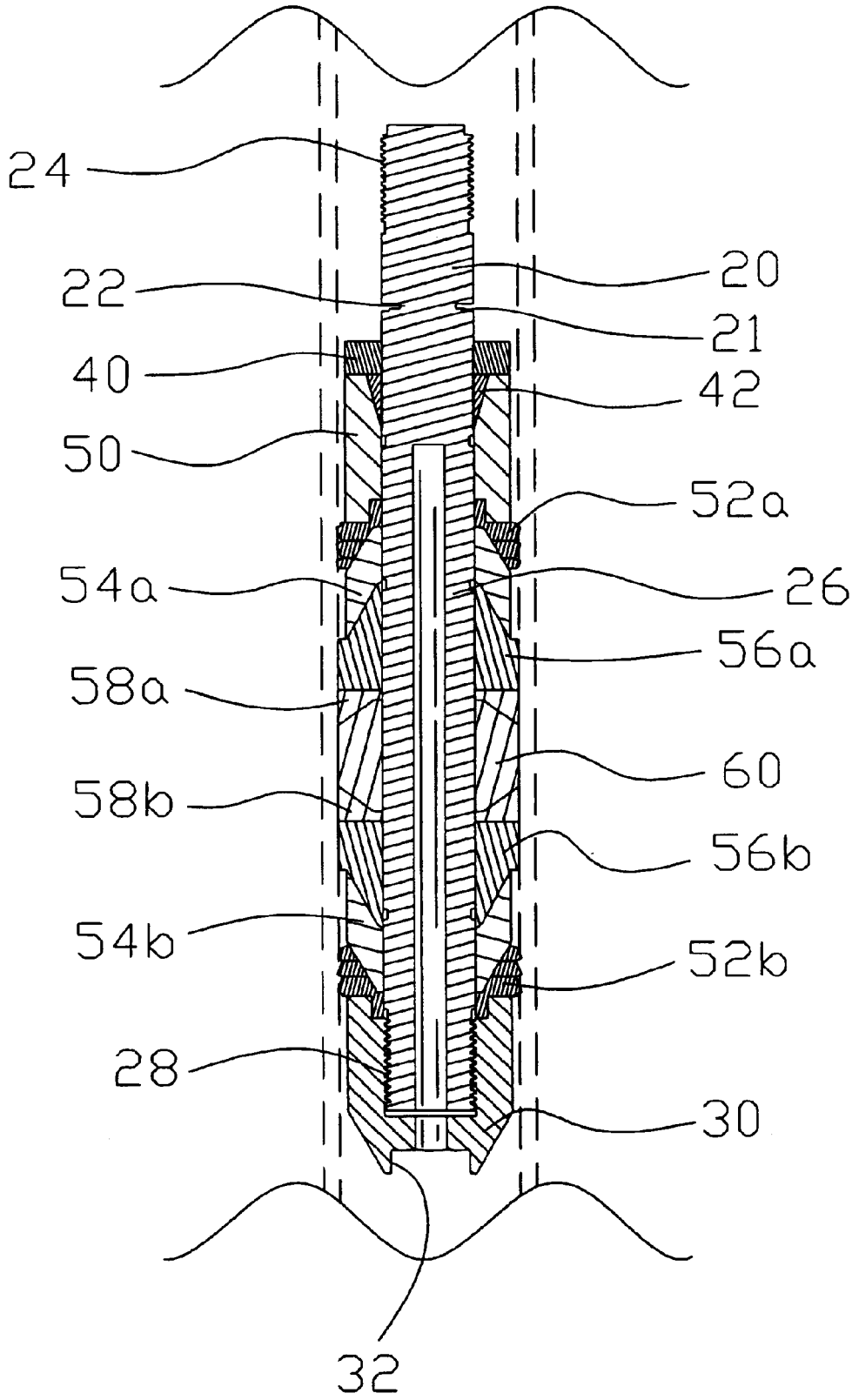
FIG. 7 is a side cutaway view of the embodiment of FIG. 6 non-movably secured within the conduit.

As shown in FIGS. 6 and 7 of the drawings, the mandrel 20 is an elongated shaft constructed of a rigid material such as but not limited to metal. The mandrel 20 preferably has a constant diameter, however the mandrel 20 may have varying diameters through the length of the mandrel 20. The length of the mandrel 20 may vary depending upon the usage required. The mandrel 20 may have various cross sectional shapes including hut not limited to circular, square and rectangular.

The mandrel 20 has an upper portion 24 which is preferably threaded for removably being engaged by a coupler 16 with an installation shaft 18 attached. There are various other structures that may be utilized for the upper portion 24 capable of securing the mandrel 20 to a coupler 16.

Figure 8:
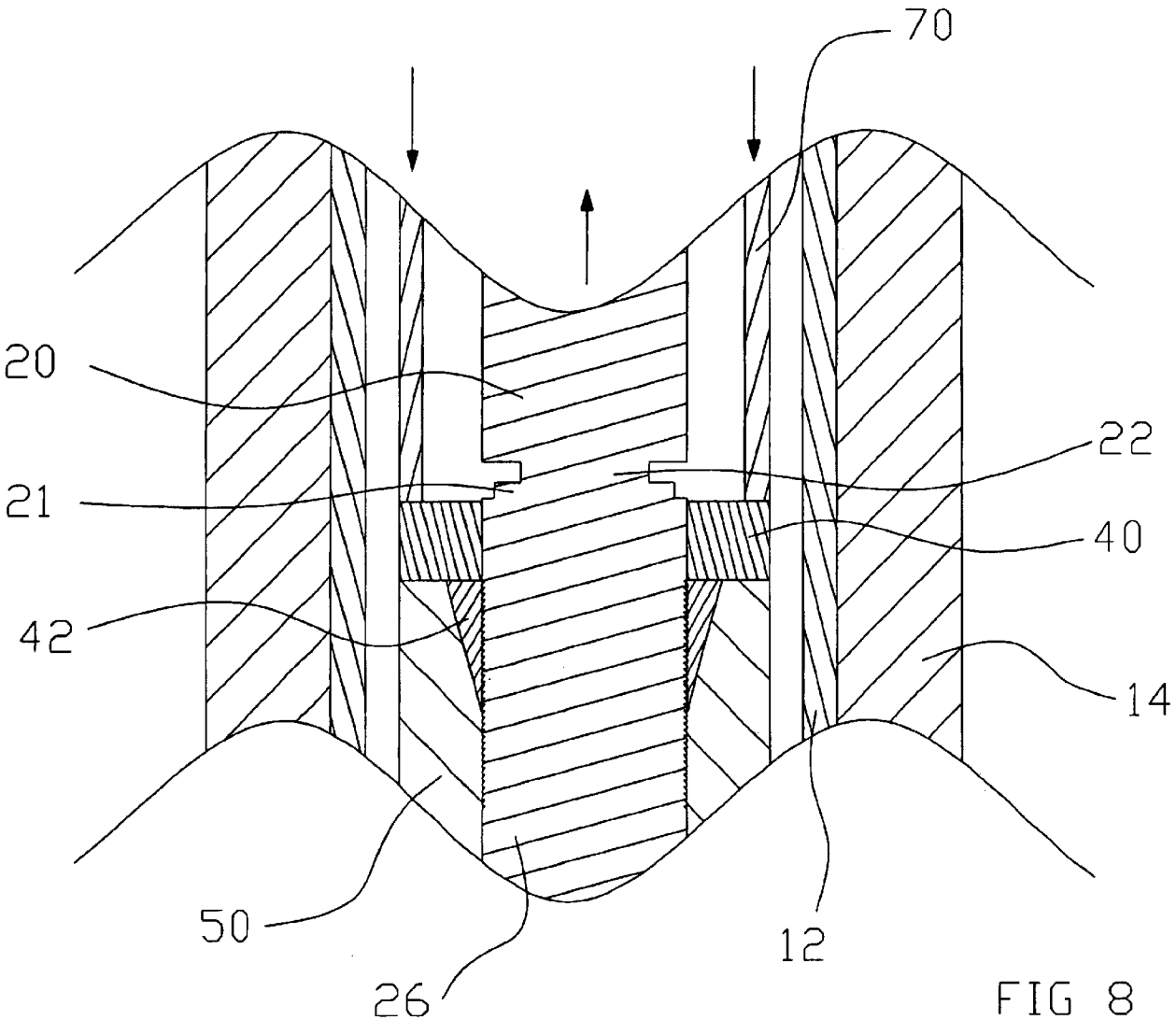
FIG. 8 is a magnified side cutaway view of the shear portion of the mandrel.
Figure 9:
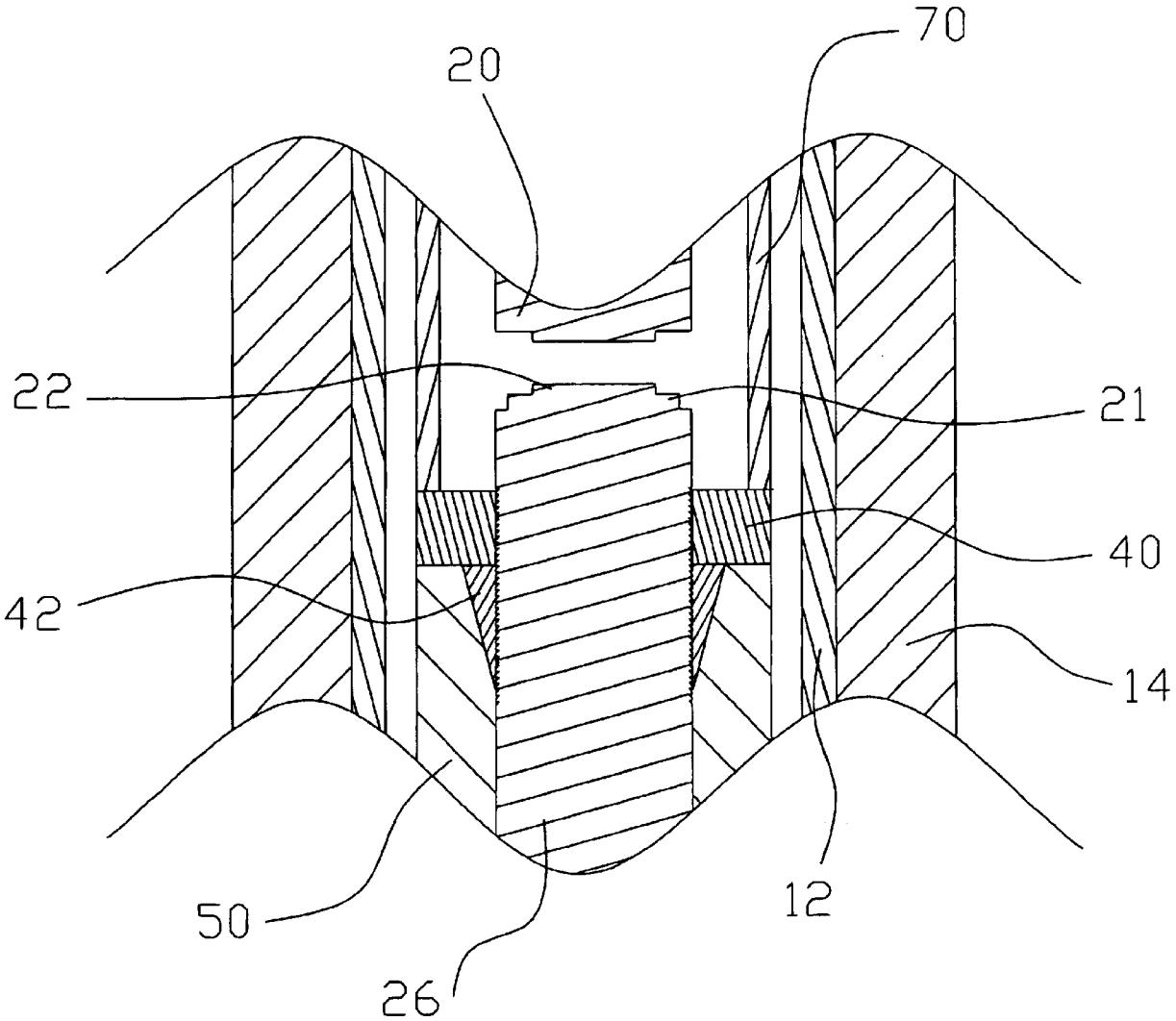
FIG. 9 is a magnified side cutaway view of the shear portion of the mandrel after being broken.

As shown in FIGS. 7, 8 and 9 of the drawings, the upper portion 24 of the mandrel 20 preferably includes a shear portion 22. The shear portion 22 is preferably a narrower portion of the mandrel 20 which may be broken after the composite bridge plug system 10 has been properly secured within the conduit 12. The shear portion 22 may be constructed of the same material utilized throughout the mandrel 20 or a weaker material to assist in the breaking of the shear portion 22. The shear portion 22 may be broken by a pulling and/or rotating force placed upon the mandrel 20 by the coupler 16.

As shown in FIG. 1 of the drawings, an engaging portion 21 preferably is positioned about the lower end of the shearing portion. The engaging portion 21 is shaped to receive a lower slot 32 within another head member 30 of another composite bridge plug system 10. The engaging portion 21 is preferably comprised of a rectangular or square structure which may be catchably retained within the lower slot 32. The engaging portion 21 has a height sufficient to provide adequate retaining of another composite bridge plug system 10 while it is being drilled out.

The mandrel 20 further has a middle portion 26 that extends longitudinally from the upper portion 24 as best shown in FIG. 6 of the drawings. A lower portion 28 extends from the middle portion 26 and preferably has a threaded exterior for threadably receiving a head member 30. The head member 30 may also be retained upon the lower portion 28 of the mandrel 20 utilizing various other securing mechanisms such as fasteners, welding and the like. The head member 30 preferably has a tapered lower end for guiding the composite bridge plug system 10 through the conduit 12.

The mandrel 20 and the head member 30 may have a longitudinal bore that extends through either partially or completely. A check valve or other device may be attached within this bore for performing various desired activities while the composite bridge plug system 10 is secured within the conduit 12.

Figure 5:
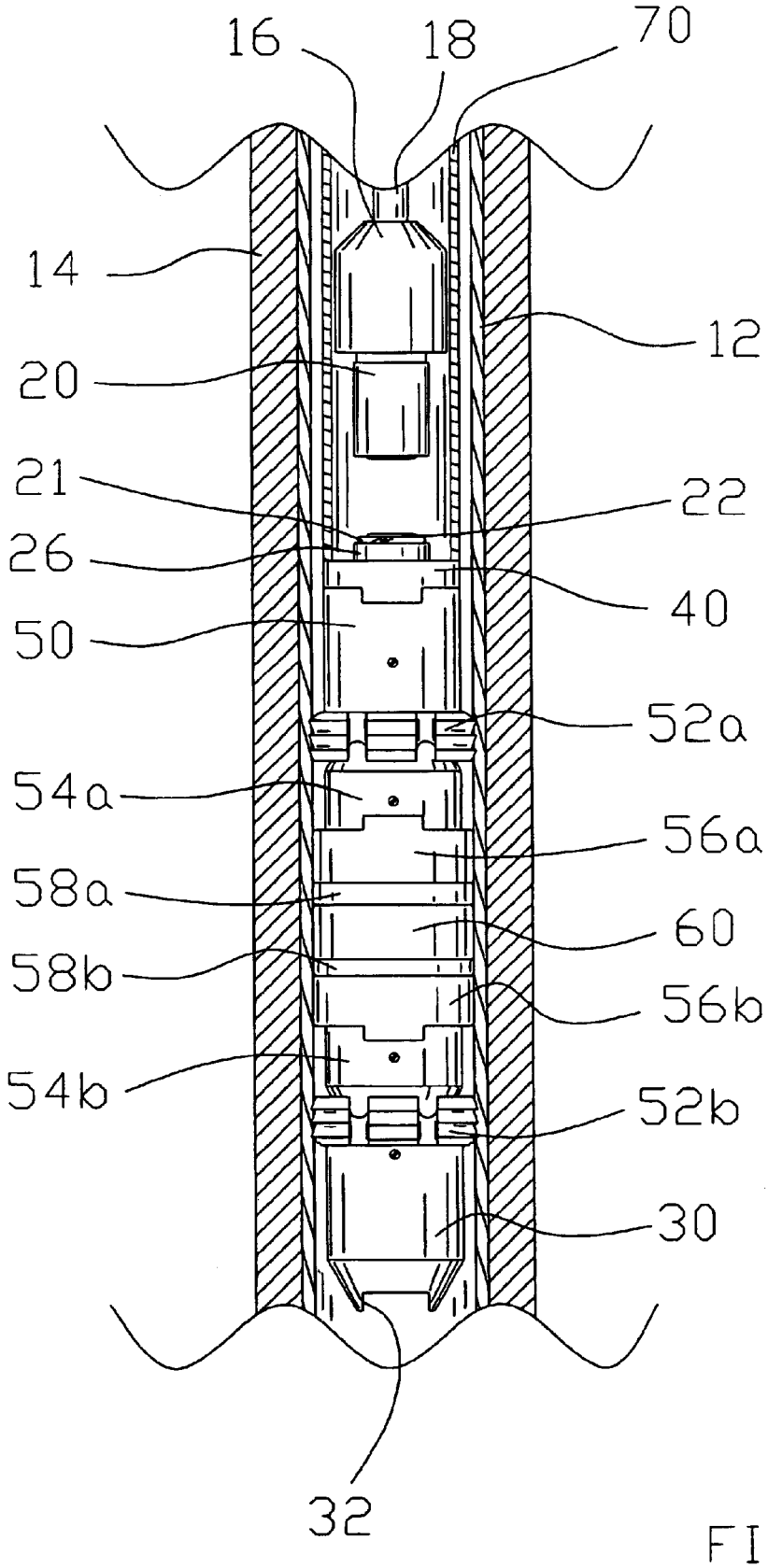
FIG. 5 is a side view of the present invention non-movably secured within the conduit.

As shown in FIGS. 1, 2, and 4–7 of the drawings, a center member 60 is positioned about the middle portion 26 of the mandrel 20. The upper and lower edges of the center member 60 are preferably angled as best shown in FIGS. 5 through 7 of the drawings. A pair of third members 58*a–b* are preferably positioned about the middle portion 26 of the mandrel 20 on opposing sides of the center member 60 as best shown in FIG. 7 of the drawings. The third members 58*a–b* have outer edges that are substantially radial with respect to the mandrel 20 with the inner edges angled to correspond to the angled edges of the center member 60.

A pair of opposing second members 56*a–b* are preferably positioned about the outer edges of the third members 58*a–b* as shown in FIGS. 5 through 7 of the drawings. The second members 56*a–b* each have a radial inner edge that corresponds to the third members 58*a–b* and a substantially tapered outer edge as shown in FIGS. 5 through 7 of the drawings.

A pair of first members 54*a–b* are preferably positioned about the middle portion 26 of the mandrel 20 upon opposing sides of the second members 56*a–b* as shown in FIGS. 1 through 7 of the drawings. The first members 54*a–b* have an angled inner and outer edge as best shown in FIGS. 5 through 7 of the drawings.

As shown in FIGS. 1 through 7 of the drawings, a pair of gripping members 52*a–b* is positioned about the middle portion 26 of the mandrel 20 on opposing sides of the first members 54*a–b*. The portion of the lower gripping member 52*b* adjacent to the head member 30 is formed to correspond to the shape of the head member 30. The lower gripping member 52*b* has a tapered inner portion which forms a conical shape as best shown in FIGS. 5 through 7 of the drawings. The outer portion of the second gripping members 52*a–b* preferably have a plurality of gripping ridges that preferably extend downwardly to engage the inner wall of the conduit 12. The gripping members 52*a–b* are preferably comprised of a metal that fractures along longitudinal channels when the gripping members 52*a–b* are forced upon the first members 54*a–b*. The gripping members 52*a–b* are preferably comprised of a material that is harder than the material utilized to construct the conduit 12.

As shown in FIGS. 1 through 7, an upper main support 50 surrounds the middle portion 26 of the mandrel 20 adjacent to the upper gripping member 52*a*. The lower edge of the upper main support 50 is formed to catchably engage the upper gripping member 52*a*. The upper inner portion of the upper main support 50 is preferably tapered outwardly in a conical shape for receiving the upper member 42. The upper member 42 is formed into a conical shape that surrounds the mandrel 20. The inner surface of the upper member 42 is preferably comprised of a gripping surface such as a plurality of ridges or teeth for engaging the mandrel 20 during compression of the composite bridge plug system 10. An upper collar 40 is positioned about upper portion 24 of the mandrel 20 adjacent to the upper member 42 and the upper main support 50 as shown in FIGS. 1 through 9 of the drawings.

The upper collar 40, first members 54*a–b* and the head member 30 are preferably comprised of a rigid and strong material such as but not limited to steel that is resistant to bending. The second members 56*a–b*, third members 58*a–b* and the center member 60 are preferably comprised of a malleable material which are capable of forming a seal within the conduit 12 when compressed and expanded such as but not limited to a polymeric material.

In use, the user utilizes the installation shaft 18 attached to the mandrel 20 via the coupler 16 to lower the composite bridge plug system 10 to the location within the conduit 12 to be sealed. The user then slides an engaging tube 70 about the installation shaft 18 adjacent to the upper collar 40 as shown in FIG. 5 in a non-movable position. The user then pulls the mandrel 20 upwardly with the installation shaft 18 while the engaging tube 70 remains stationary with respect to the conduit 12. As the mandrel 20 is drawn upwardly, the head member 30 is pulled upwardly thereby compressing the upper member 42, upper main support 50, gripping members 52*a–b*, first members 54*a–b*, second members 56*a–b*, third members 58*a–b* and center member 60 between the head member 30 and the upper collar 40. The compression force first causes the center member 60, third members 58*a–b* and second members 56*a–b* to expand outwardly against the inner wall of the conduit 12 which is supported within an outer wall 14 as shown in FIG. 7 of the drawings. The compression force then causes the gripping members 52*a–b* to expand and break apart thereby penetrating the inner wall of the conduit 12 to prevent movement of the composite bridge plug system 10 within the conduit 12. The upper member 42 is compressed about the mandrel 20 thereby preventing the mandrel 20 from falling through into the conduit 12 after the coupler 16 is removed. After the composite bridge plug system 10 has been properly seated within the conduit 12, the user then rotates the installation shaft 18 while pulling upwardly thereby breaking the shear portion 22. The upper portion 24 of the mandrel 20 is then removed from the conduit 12. When the user desires to drill out the composite bridge plug system 10 from the conduit 12, the user drills into the mandrel 20 and the upper collar 40 first. The composite bridge plug system 10 may slide downwardly and rotate within the conduit 12. As the composite bridge plug system 10 slides downwardly, the head member 30 engages the engaging portion 21 of a lower composite bridge plug system 10 within the conduit 12 within the lower slot 32 thereby preventing rotation of the composite bridge plug system 10. The composite bridge plug system 10 is then continued to be drilled or milled out as desired.

Figure 3:
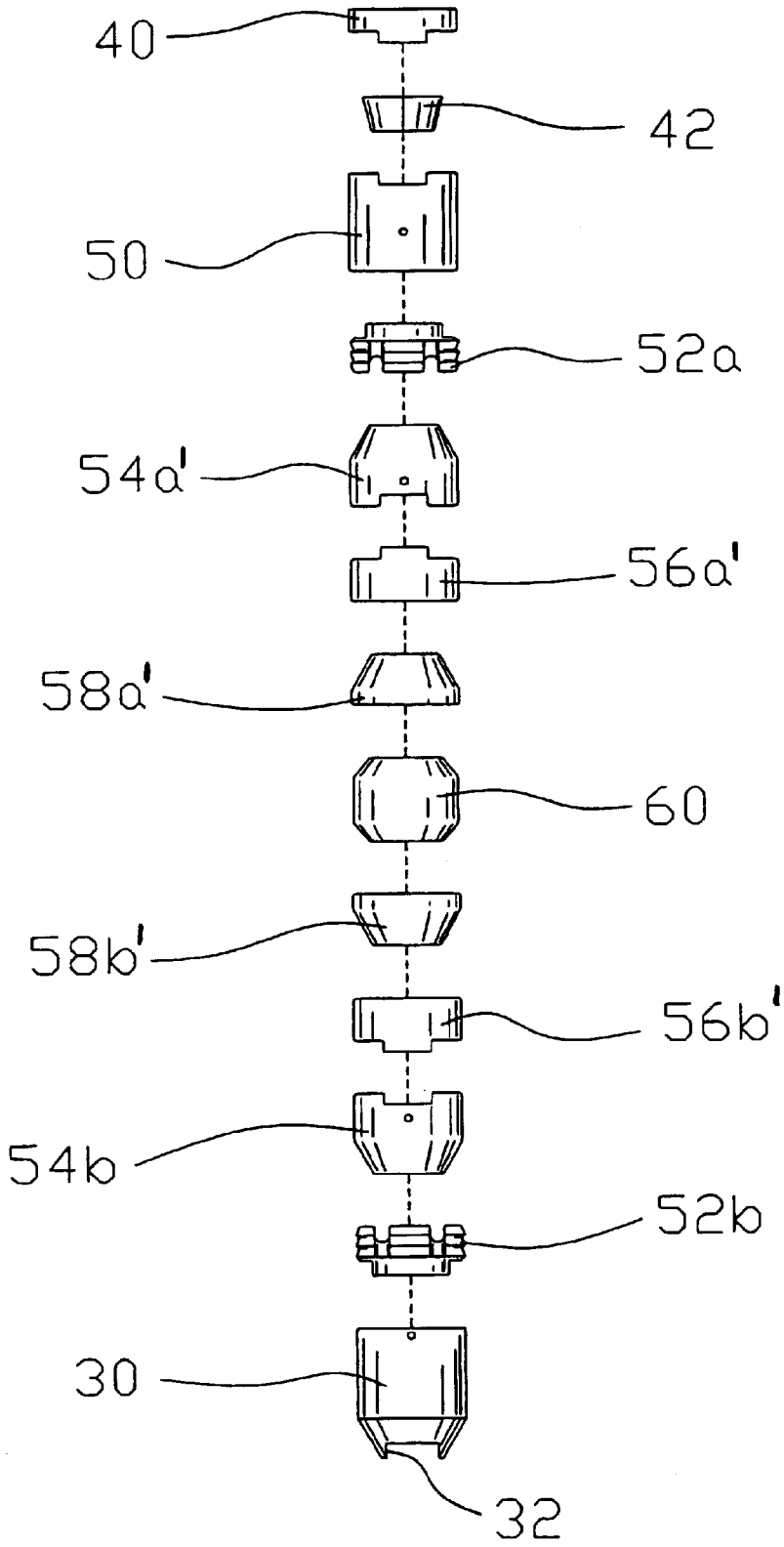
FIG. 3 is an exploded side view of one embodiment of the present invention.
Figure 4:
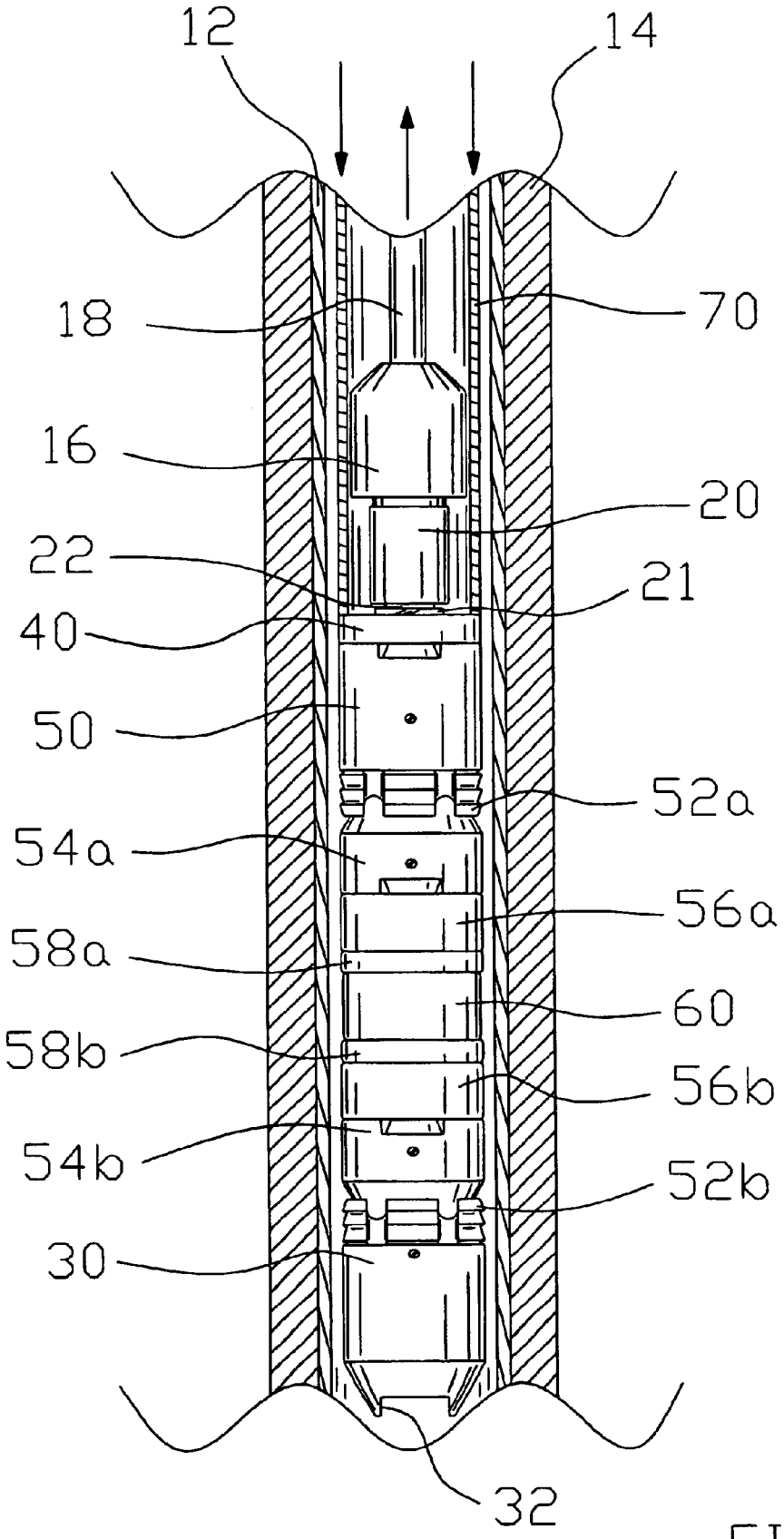
FIG. 4 is a side view of the present invention movably positioned within a conduit.

Referring to FIG. 3, a slightly different embodiment of this invention is illustrated using identical reference characters for identical elements and primed reference characters for the changed components. Instead of the third member 58*a* having a flat upper surface and the third member 58*b* having a flat lower surfaces as in FIGS. 6 and 7, the third members 58*a*' and 58*b*' have tapered upper and lower surfaces. This requires the second elements 56*a*' and 56*b*' to have tapered mating surfaces but flat opposing surfaces. This requires the first members 54*a*' and 54*b*' to be modified to provide complementary mating surfaces. Operation of the embodiment of FIG. 3 is essentially the same as the embodiment of FIG. 6 and FIG. 7 because the gripping members 52*a–b* and the malleable members are expanded in response to use of the coupler 16 and shaft 18.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bridge plug comprising a mandrel having a longitudinal axis, an upper portion, a middle portion and a lower portion;

a head member attached to the lower portion of the mandrel;

an upper collar positioned about the upper portion of the mandrel;

an upper gripping member and a lower gripping member positioned about the middle portion of the mandrel; and a mechanism for expanding the gripping members and for sealing the bridge plug against a surround tubular including a center member between the gripping members having a tapered upwardly converging upper end and a tapered downwardly converging lower end, a plurality of upper members between the center member and the upper gripping member including a lower element having a tapered upwardly converging lower end in engagement with the center member and an upper element having a tapered upwardly converging upper end in engagement with the upper gripping member, a plurality of lower members between the center member and the lower gripping member including an upper element having a tapered downwardly converging upper end in engagement with the center member and a lower element having a tapered downwardly converging lower end in engagement with the lower gripping member, at least one of the center member, the upper members and the lower members being malleable and capable of forming a seal when compressed.

2. A bridge plug comprising a mandrel having a longitudinal axis, an upper portion, a middle portion and a lower portion;

a head member attached to the lower portion of the mandrel;

an upper collar positioned about the upper portion of the mandrel;

at least one gripping member positioned about the middle portion of the mandrel; and the at least one sealing member positioned about the middle portion of the mandrel and positioned between the head member and the at least one gripping member;

the upper portion of the mandrel including a connecting portion for attachment to a setting tool and a shear portion between the connecting portion and the middle portion of the mandrel so expanding the gripping member causes the upper portion of the mandrel to shear off at the shear portion whereby the upper portion of the mandrel is removed from the bridge plug during setting of the bridge plug.

the middle portion of the mandrel includes an upwardly facing engaging portion below the shear portion and the head member includes a slot for catchably retaining an engaging portion of a subjacent bridge plug having an identical engaging portion.

3. The bridge plug of claim 2 wherein the engaging portion is above the collar.

4. A bridge plug comprising a mandrel having a longitudinal axis, an upper portion, a lower portion, a middle portion and an upwardly facing engaging portion in a set condition of the bridge plug for engaging a slot in a superposed bridge plug, the engaging portion comprising a torque transmitting connection;

a head member attached to the lower portion of the mandrel having a slot for catchably retaining the engaging portion of a superposed bridge plug;

an upper collar positioned about the upper portion of the mandrel;

at least one gripping member positioned about the middle portion of the mandrel;

at least one sealing member positioned about the middle portion of the mandrel and positioned between the head member and the at least one gripping member.

* * * * *

UNITED STATES PATENT AND TRADEMARK OFFICE

CERTIFICATE OF CORRECTION

PATENT NO. : 6,796,376 B2
APPLICATION NO. : 10/189887
DATED : September 28, 2004
INVENTOR(S) : Warren L. Frazier It is certified that error appears in the above-identified patent and that said Letters Patent is hereby corrected as shown below:

Figure 3, "54b" should be --54b'--.

Column 6, line 65: delete "the" from before "at least one sealing member".

Column 7, line 8: "the bridge plug." should read --the bridge plug,--.

Signed and Sealed this

Twenty-second Day of December, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 6,796,376 B2
APPLICATION NO. : 10/189887
DATED : September 28, 2004
INVENTOR(S) : Warren L. Frazier It is certified that error appears in the above-identified patent and that said Letters Patent is hereby corrected as shown below:

Column 8, line 7: "superposed" should read --subjacent--.

Signed and Sealed this
Fifteenth Day of February, 2011

David J. Kappos

David J. Kappos
*Director of the United States Patent and Trademark Office*